US008216053B2

(12) United States Patent
Jaffe

(10) Patent No.: US 8,216,053 B2
(45) Date of Patent: Jul. 10, 2012

(54) WAGERING GAME WITH SINGLE-SYMBOL REEL FOR ENHANCING WINNING COMBINATIONS

(75) Inventor: Joel R. Jaffe, Glenview, IL (US)

(73) Assignee: WMS Gaming Inc., Waukegan, IL (US)

( * ) Notice: Subject to any disclaimer, the term of this patent is extended or adjusted under 35 U.S.C. 154(b) by 493 days.

(21) Appl. No.: 12/513,958

(22) PCT Filed: Nov. 5, 2007

(86) PCT No.: PCT/US2007/023257

§ 371 (c)(1),
(2), (4) Date: May 7, 2009

(87) PCT Pub. No.: WO2008/063388

PCT Pub. Date: May 29, 2008

(65) Prior Publication Data

US 2010/0137055 A1 Jun. 3, 2010

Related U.S. Application Data

(60) Provisional application No. 60/858,298, filed on Nov. 9, 2006.

(51) Int. Cl.
*A63F 9/24* (2006.01)

(52) U.S. Cl. ..... 463/20; 463/17; 463/30

(58) Field of Classification Search ..... 463/17, 463/20, 30

See application file for complete search history.

(56) References Cited

U.S. PATENT DOCUMENTS

| | | | | |
|---|---|---|---|---|
| 6,190,254 | B1 | 2/2001 | Bennett | 463/13 |
| 6,517,433 | B2 | 2/2003 | Loose et al. | 463/20 |
| 6,544,120 | B2 | 4/2003 | Ainsworth | 463/20 |
| 6,551,187 | B1 | 4/2003 | Jaffe | 463/20 |
| 7,077,745 | B2 * | 7/2006 | Gomez et al. | 463/20 |
| 7,604,538 | B2 * | 10/2009 | Pacey | 463/20 |
| 2005/0159208 | A1 | 7/2005 | Pacey | 463/20 |
| 2005/0164774 | A1 | 7/2005 | Gauselmann | 463/20 |
| 2005/0215311 | A1 | 9/2005 | Hornik et al. | 463/20 |
| 2006/0058097 | A1 | 3/2006 | Berman et al. | 463/20 |
| 2006/0068892 | A1 | 3/2006 | Gomez et al. | 463/20 |

OTHER PUBLICATIONS

International Search Report—PCT/US2007/023257 mailed Apr. 18, 2008 (2 pages).

International Written Opinion—PCT/US2007/023257 mailed Apr. 18, 2008 (5 pages).

* cited by examiner

*Primary Examiner* — Ronald Laneau

*Assistant Examiner* — Wilner Jean Baptiste

(74) *Attorney, Agent, or Firm* — Nixon Peabody LLP

(57) ABSTRACT

A system and method for conducting a wagering game providing an opportunity to earn an increased award is disclosed. A randomly selected outcome from a plurality of possible outcomes is displayed. The plurality of possible outcomes each including a plurality of symbols arranged in an array. An additional symbol is displayed separate from the array. If the displayed randomly selected outcome includes a winning symbol combination resulting in a first award, a determination is made whether the displayed additional symbol can be combined with the winning symbol combination to yield a second award being larger than the first award. The first award is provided if the additional symbol cannot be combined with the winning symbol combination to yield the second award. The larger second award is provided if the additional symbol can be combined with the winning symbol combination to yield the second award.

20 Claims, 8 Drawing Sheets

WAGERING GAME WITH SINGLE-SYMBOL REEL FOR ENHANCING WINNING COMBINATIONS

CROSS-REFERENCE TO RELATED APPLICATIONS

This application is a U.S. national stage of International Application No. PCT/US2007/023257, filed Nov. 5, 2007, which is related to and claims the benefit of U.S. Provisional Application No. 60/858,298, filed Nov. 9, 2006, each of which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a wagering game including a supplemental symbol adapted to extend winning symbol combinations.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines.

Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

Another way to increase the entertainment value of a game is to enhance the display of the gaming machines. For gaming machines with video displays, improvements in video technology have enabled the display of richer and more colorful graphics. For gaming machines with mechanical displays, however, the enhancements early on were less technologically advanced. For example, some mechanical reel symbols were colored by backlighting the mechanical symbols with colored lighting elements. Sometimes the reel itself might contain electroluminescent elements that defined one or more reel symbols. To display a symbol in multiple colors or formats using such an arrangement, multiple electroluminescent elements were needed for the symbol.

Recent advances in transmissive display technology have made it possible to more easily modify the appearance of mechanical displays. A transmissive display is essentially a transparent video display that is superimposed over the mechanical display. The transmissive display may then be operated to display selected video images over the mechanical display. These video images may include translucent portions such that the underlying mechanical display is visible, but in an altered state (i.e., different color, texture, etc.). The video images may also include opaque portions so as to completely block out parts of the underlying mechanical display.

The above-described transmissive display technology gives wagering game designers the capability and flexibility to more easily design and modify the appearance of mechanical displays. Accordingly, there is a need to develop new and improved wagering games for mechanical displays using this technology, with features that take full advantage of the capabilities of the transmissive display to thereby enhance the entertainment value of the wagering games.

SUMMARY OF THE INVENTION

According to one aspect of the present invention, a method of conducting a wagering game providing an opportunity to earn an increased award is disclosed. The method comprises displaying a randomly selected outcome from a plurality of possible outcomes. The plurality of possible outcomes each including a plurality of symbols arranged in an array. The method further comprising displaying an additional symbol separate from the array. If the displayed randomly selected outcome includes a winning symbol combination resulting in a first award, the method also includes determining whether the displayed additional symbol can be combined with the winning symbol combination to yield a second award being larger than the first award. The first award is provided if the additional symbol cannot be combined with the winning symbol combination to yield the second award. The larger second award is provided if the additional symbol can be combined with the winning symbol combination to yield the second award.

According to another aspect of the present invention, a method of conducting a wagering game allowing an opportunity to form an enhanced winning symbol combination comprises receiving a primary wager from the player for playing the wagering game. The method further comprises initiating the wagering game and displaying, via a plurality of reels having symbols thereon, a randomly selected outcome for the wagering game. The method also includes displaying a supplemental symbol in addition to the randomly selected outcome. The supplemental symbol being initially displayed separately from the plurality of reels. In response to the randomly selected outcome forming a winning symbol combination and the supplemental symbol matching the winning symbol combination, the method additionally includes combining the supplemental symbol in conjunction with the winning symbol combination to form an enhanced winning symbol combination.

According to yet another aspect of the present invention, a gaming system for playing a wagering game comprises a wager input device for receiving a primary wager to play a game of the wagering game. The gaming system further comprises a display for displaying a randomly selected outcome of the game and a supplemental symbol. The randomly selected outcome is indicated by a plurality of symbols arranged in an array and the supplemental symbol is unassociated with the array. A first award is provided in response to the randomly selected outcome forming a winning symbol combination. A second award is provided if the supplemental symbol matches the winning symbol combination. The second award is greater than the first award.

Additional aspects of the invention will be apparent to those of ordinary skill in the art in view of the detailed description of various embodiments, which is made with reference to the drawings, a brief description of which is provided below.

Figure 1:
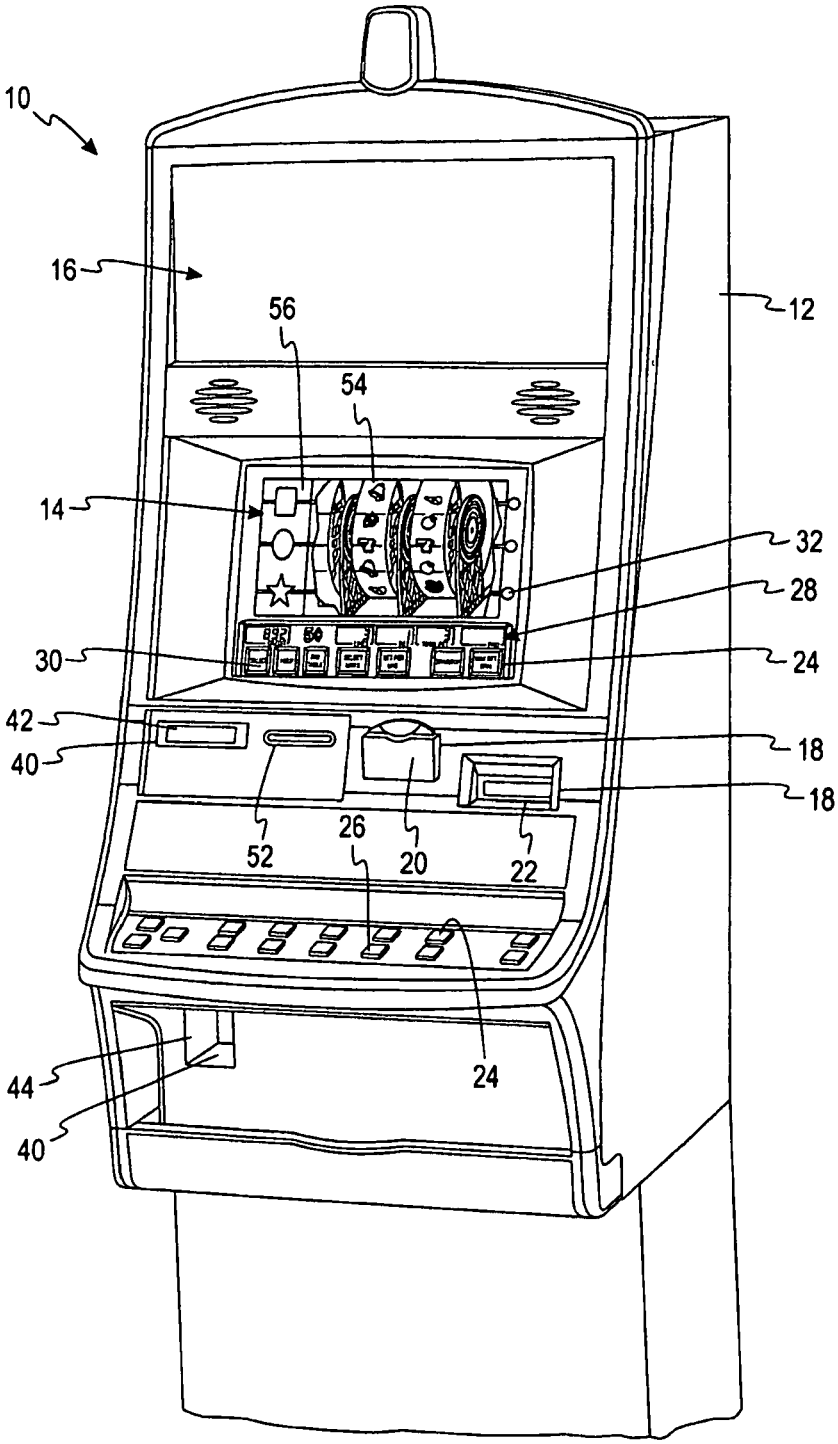
FIG. 1 is a perspective view of a free standing gaming machine embodying the present invention.

While this invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail various embodiments of the invention with the understanding that the present disclosure is to be considered as an exemplification of the principles of the invention and is not intended to limit the broad aspect of the invention to the embodiments illustrated.

Referring to FIG. 1, a mechanical reel gaming machine 10 similar to those used in gaming establishments, such as casinos, is shown. The gaming machine 10 comprises a housing 12 and a number of input devices, including a value input device 18 and a player input device 24. For outputs, the gaming machine 10 comprises a primary display area 14 for displaying information about base wagering games and a secondary display area 16 for displaying game events, game outcomes, and/or signage information. The primary display area 14 and/or secondary display area 16 may also display information about bonus wagering games and progressive wagering games. In accordance with embodiments of the invention, the primary display area 14 comprises a plurality of mechanical reels 54 and a transmissive display 56 superimposed over the mechanical reels 54. Each of the foregoing components is described in more detail below. While the exemplary embodiments described below refer to the mechanical reels 54, in other embodiments the mechanical reels 54 can be replaced with video reels 54' (see FIG. 3). Thus, alternatively, the primary display area 14 can include the transmissive display 56 being superimposed over a plurality of video reels 54.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency. Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like on the primary display area 14 (over the transmissive display 56) and/or on secondary display area 16. The touch screen 28 contains soft touch keys 30 denoted by graphics on the underlying primary display area 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

A player begins play of the base wagering game by making a wager via the value input device 18 of the gaming machine 10. A player can select play by using the player input device 24, via the buttons 26 or the touch screen keys 30. The base game consists of a plurality of symbols arranged in an array, and includes at least one payline 32 that indicates one or more outcomes of the base game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display area 16 or other dedicated player-tracking display for providing the player with information about his or her account or other player-specific information. Also, in some embodiments, the information reader 52 may be used to restore game assets that the player achieved and saved during a previous game session.

In the illustrated embodiment, the gaming machine 10 is an "upright" version in which the primary display area 14 is oriented vertically relative to the player. Alternatively, the gaming machine may be a "slant-top" version in which the primary display area 14 is slanted at about a thirty-degree angle toward the player of the gaming machine 10. Furthermore, although only three mechanical reels are shown in the primary display area 14, those having ordinary skill in the art will recognize that the gaming machine 10 may comprise fewer or more mechanical reels (e.g., four reels, five reels, etc.), depending on the particular configuration of the primary display area 14.

Figure 2A:
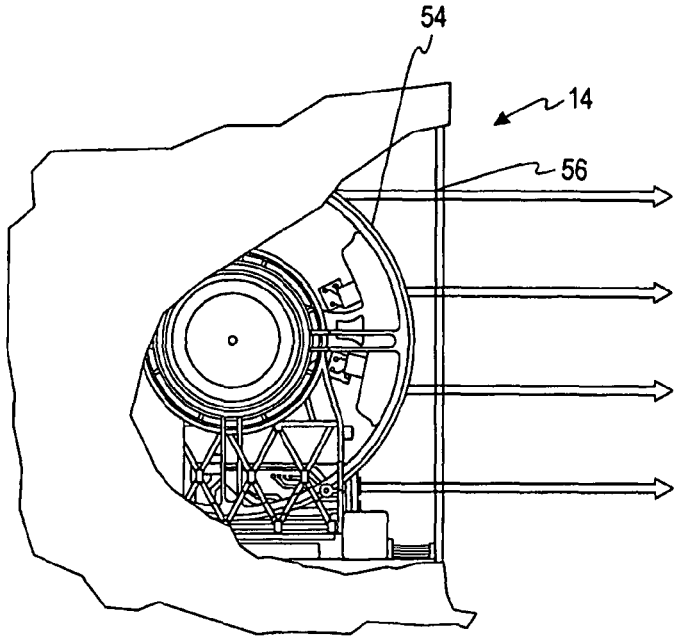
FIGS. 2*a*-2*b* are cross-sectional side views of a display area embodying the present invention.
Figure 2B:
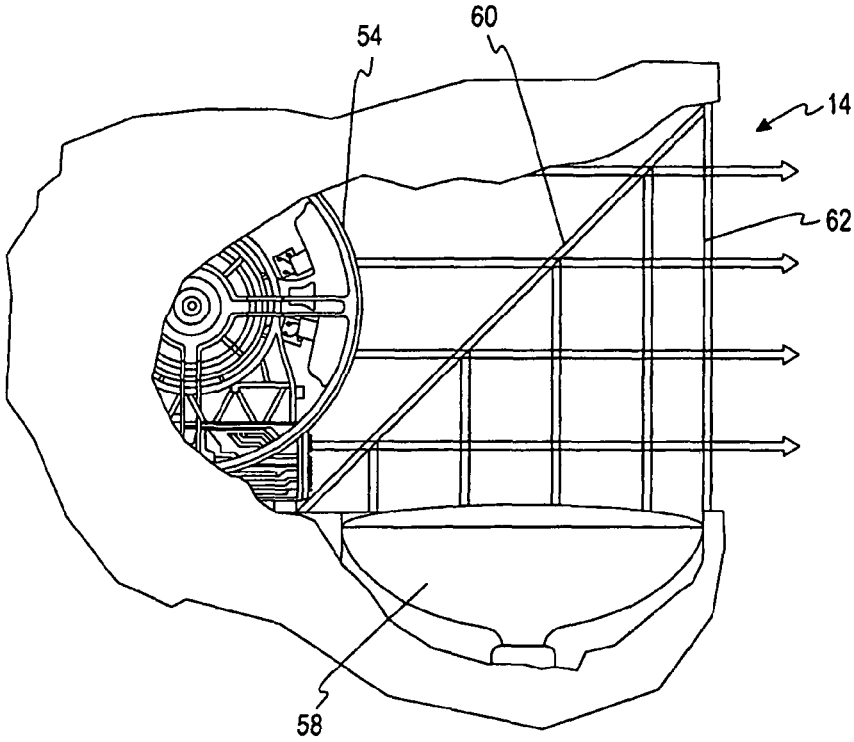

FIGS. 2*a*-2*b* illustrate exemplary implementations of the primary display area 14 in which a video image is superimposed over the mechanical reels 54. Although not expressly labeled, each reel of the mechanical reels 54 has a plurality of reel symbols (see FIG. 1) that represent a randomly-selected outcome of the wagering game. The video image may then be positioned over the mechanical reels 54 to enhance and/or alter the appearance (e.g., color, texture, etc.) of the mechanical reels 54. There are at least two possible configurations for the primary display area 14: a direct image configuration (FIG. 2*a*), and a virtual image configuration (FIG. 2*b*). These configurations are described below.

Referring to FIG. 2*a*, in the direct image configuration, a transmissive display 56 is positioned directly in front of the mechanical reels 54 and generates a direct image. In such an arrangement, the transmissive display 56 may be a flat panel transmissive video display, for example, a transmissive liquid crystal display (LCD) commercially available from LG Phillips LCD Co., Ltd., of Seoul, Korea, Sharp Electronics Corp. of Tokyo, Japan, and other display manufacturers. The flat panel transmissive video display is preferably preconfigured with the touch screen 28 (see FIG. 1) mounted to a front surface of the display.

In the virtual image configuration, shown in FIG. 2*b*, a reflected video image is used instead of a direct image. In such an arrangement, the reflected video image may be generated by, for example, a standard video display 58 and a partially reflective mirror 60. The standard video display 58 may be mounted below the mechanical reels 54 and substantially normal thereto, and the partially reflective mirror 60 may be positioned over the mechanical reels 54 at a predetermined angle (e.g., 45 degrees). Video images from the standard video display 58 are then reflected off the partially reflective mirror 60 so that they appear to a player to be superimposed over the mechanical reels 54. The video projection display 58 may be any suitable video projection display known to those having ordinary skill in the art, including a CRT, LCD, dot matrix, LED, electro luminescent, and the like. In some embodiments, the primary display area 14 further comprises a transparent glass cover/window 62 positioned over the partially reflective mirror 60 to protect the mirror 60. Such a cover/window 62 may be optionally configured with the touch screen 28 for receiving player input.

The superimposed video images may be selectively made transparent, semi-transparent (i.e., translucent), or opaque in selected places. This allows preselected images to be displayed over certain portions of the primary display area 14, with the result that certain areas of the primary display area 14 are either altered in some way (e.g., highlighted, colored, etc.), or completely blocked by the superimposed images. All video images superimposed on the primary display area 14 may be rendered in two-dimensional (e.g., using Flash Macromedia™) or three-dimensional graphics (e.g., using Renderware™). The images may be played back (e.g., from a recording stored on the gaming machine 10), streamed (e.g., from the gaming network), or received as a TV signal (e.g., either broadcast or via cable). The images may be animated, or they may be real-life images, either prerecorded (e.g., in the case of marketing/promotional material) or as live footage, and the format of the video images may be an analog format, a standard digital format, or a high-definition (HD) digital format. Using superimposed video images in this way allows numerous types of improvements and enhancements to be made to the appearance of the primary display area 14 in real time and during on-going game play.

For information regarding the use of video overlay technology in gaming machines and for embodiments employing video overlay displays, the reader is referred to commonly assigned U.S. Published Application No. 20040198485, titled "Gaming Machine with Superimposed Display Image," filed on Nov. 7, 2003, and also to commonly-assigned U.S. Pat. No. 6,517,433, titled "Reel Spinning slot Machine With Superimposed Video Image," issued on Feb. 11, 2003, each of which being incorporated herein by reference in its entirety.

Figure 3:
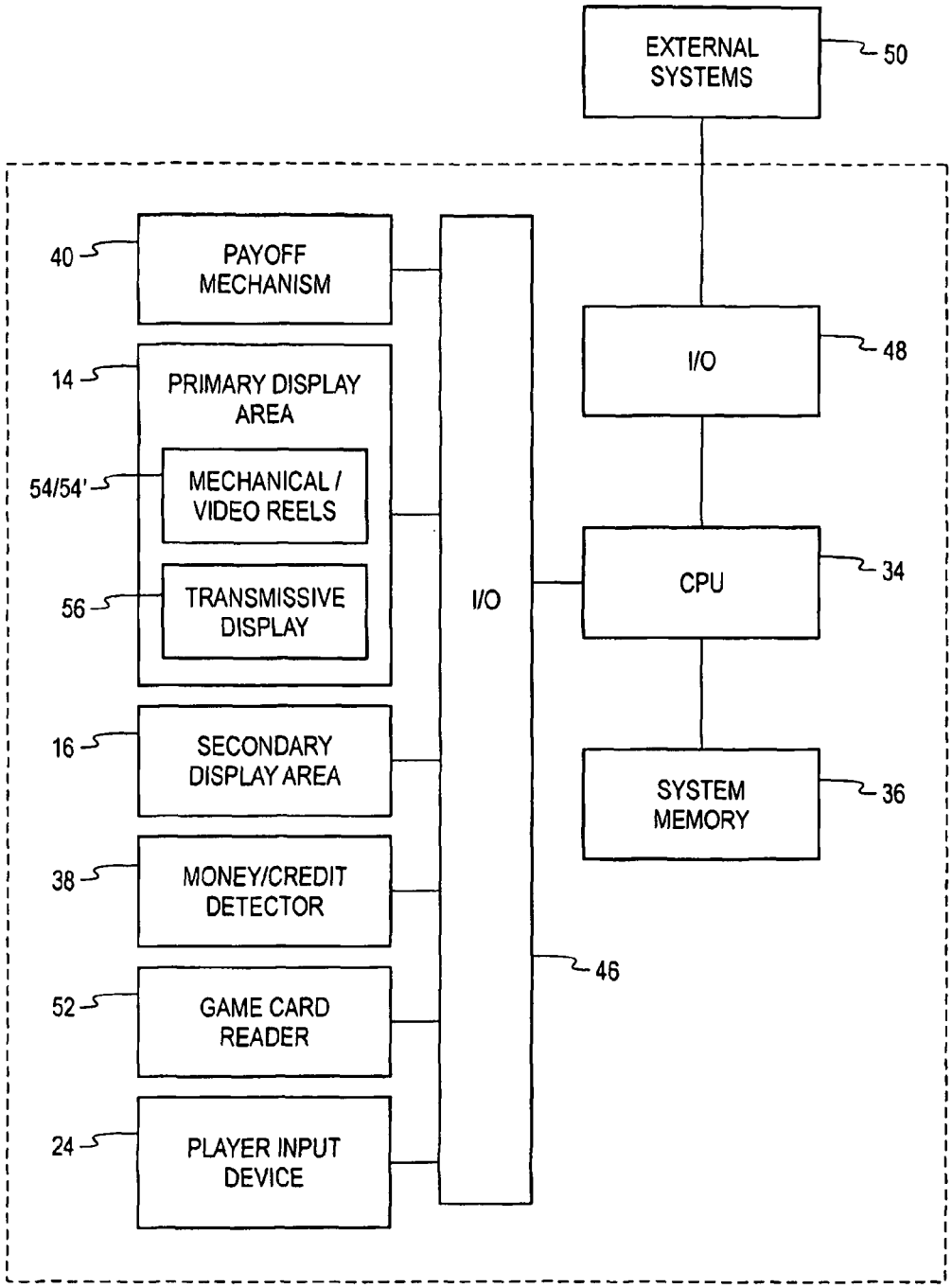
FIG. 3 is block diagram of a control system suitable for operating the gaming machine of FIG. 1.

Turning now to FIG. 3, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10, but may be located outboard of the housing 12 and connected to the remainder of the components of the gaming machine 10 via a variety of different wired or wireless connection methods.

As seen in FIG. 3, the controller 34 is also connected to, and controls, the primary display area 14, the player input device 24, and a payoff mechanism 40. The primary display area 14 in this embodiment uses the transmissive display 56 to superimpose a video image over the mechanical/video reels 54/54', but a reflected image arrangement (see FIG. 2*b*) may also be used in other embodiments. The payoff mechanism 40 is operable in response to instructions from the controller 34 to award a payoff to the player in response to certain winning outcomes that might occur in the base game or the bonus game(s). The payoff may be provided in the form of points, bills, tickets, coupons, cards, and the like. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, and the like. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 3, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10.

By virtue of the superimposed video images, a variety of traditional as well as visually-enhanced wagering games involving the mechanical reels 54 may be played on the gaming machine 10. These wagering games may be provided to the gaming machine 10 using any suitable means known to those having ordinary skill in the art, including hardware upgrades as well as direct downloads via external systems 50. In the latter case, the gaming machine 10 may communicate with the external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "rich client" configuration, the server determines game outcomes, while the controller 34 on board the gaming machine executes game code and processes display information to be displayed on the display(s) of the machines. Numerous alternative configurations are possible such that the aforementioned and other functions may be performed onboard or external to the gaming machine 10 as may be necessary for particular applications.

Thus far, embodiments of the invention have only been described as video images being superimposed on the primary display area 14. It is also possible, however, to superimpose the video images on the secondary display area 16 as well without departing from the scope of the invention. Still, in most embodiments, the primary display area 14 is the one with the video images superimposed thereon. The reason for this is because in most gaming machines 10, the primary display area 14 is the one that includes the mechanical reels (e.g., for a slot machine), a mechanical wheel (e.g., a roulette game), one or more dice, a pachinko board, or other board game. In alternative embodiments, however, the primary display area 14 may include video reels 54' by using a video display such as a CRT or LCD. Video images may then be superimposed on the video reels 54' as needed. In further alternative embodiments, the primary display area 14 may include a diorama presenting a three-dimensional model of a game environment. The diorama may be stationary in some implementations, or it may slide or move around in one or more dimensions.

Figure 4:
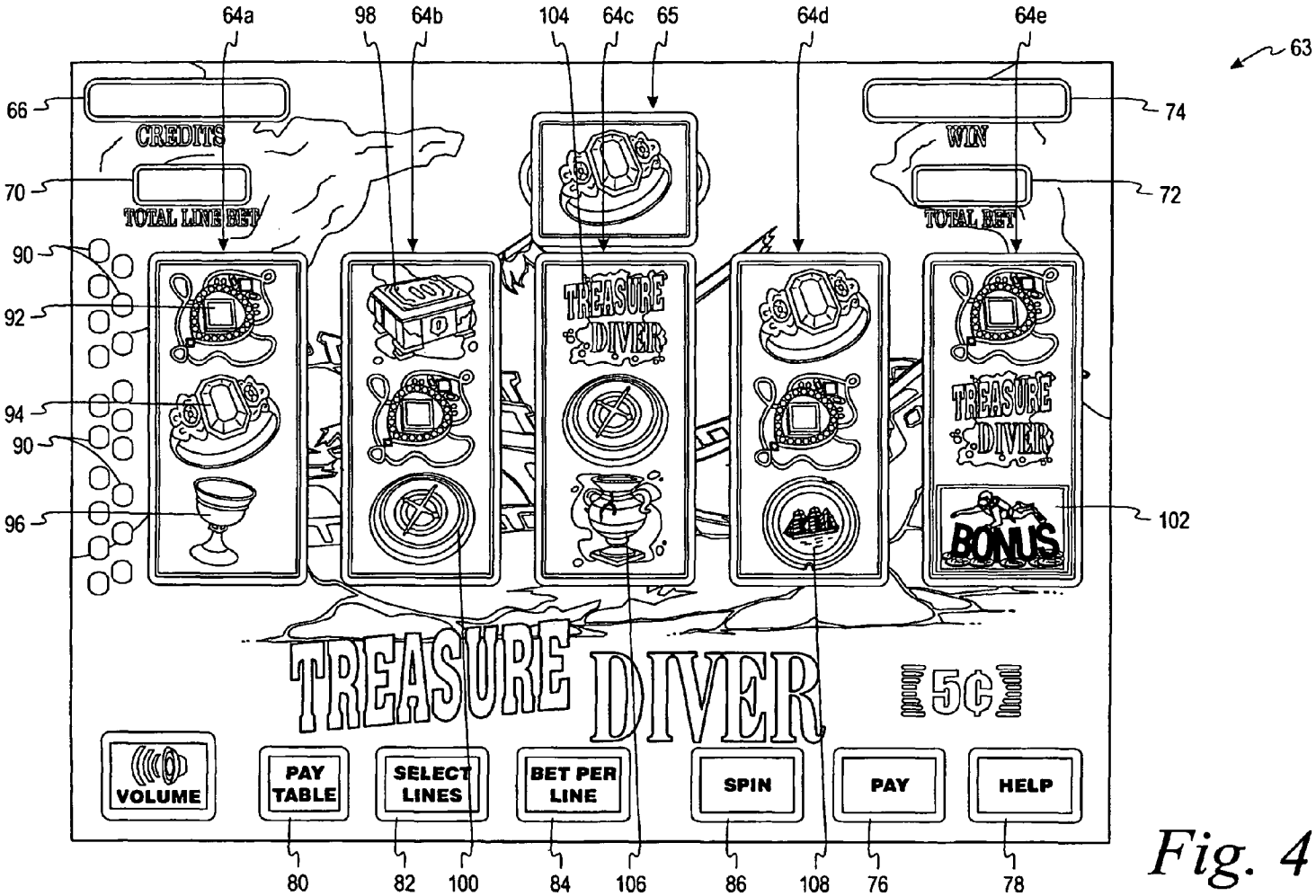
FIG. 4 is a screen view of a game incorporating the present invention capable of being displayed on the gaming machine of FIG. 1.

Turning now to FIG. 4, an image of a main game screen 63 is illustrated, according to one embodiment of the present invention. A player begins play of a basic wagering game by inserting a wager into the value input device 18 of the gaming machine 10. A player can select play by using the player input device 24, via the buttons 26 or the touch screen keys 30. The CPU 34 (or a wagering-game control network in alternative embodiments) operates to execute a wagering game program causing the primary display area 14 to display the wagering game that includes a plurality of visual elements.

The main game screen 63 may be displayed on the primary display area 14 or on a portion thereof. In some embodiments, portions of the main game screen 63 may be displayed by superimposing a video image over mechanical reels (e.g., mechanical reels 54) or video reels (e.g., video reels 54'), as will be described in further detail below. In the illustrated embodiment, the main game screen 63 is used to display a plurality of reels 64*a-e* with symbols displayed thereon. The reels 64*a-e* are positioned such that the symbols are displayed relative to at least one payline 32 (FIG. 1*a*), yielding a plurality of outcomes for the basic game. The main game screen 63 also includes a supplemental single-symbol reel 65 that will be described in more detail below.

The main game screen 63 may also display a plurality of game session meters and various buttons selectable by a player. The game session meters include a "credit" meter 66 for displaying a number of credits available for play on the machine; a "total line bet" meter 70 for displaying a number of credits wagered for the number of paylines played; a "total bet" meter 72 for displaying a total number of credits wagered for the particular round of wagering; and a "win" meter 74 for displaying an amount to be awarded based on the results of the particular round of wagering. The user-selectable buttons include a "pay" button 76 to collect the credits remaining in the credits meter 66; a "help" button 78 for viewing instructions on how to play the wagering game; a "pay table" button 80 for viewing a pay table associated with the basic wagering game; a "select lines" button 82 for changing the number of paylines (displayed in the lines meter 68) a player wishes to play; a "bet per line" button 84 for changing the amount of the wager which is displayed in the line bet meter 70; and a "spin" button 86 for moving the reels 64*a-e* and the reel 65. While the gaming machine 10 allows for these types of player inputs, the present invention does not require them and can be used on gaming terminals having more, less, or different player inputs.

Figure 5:
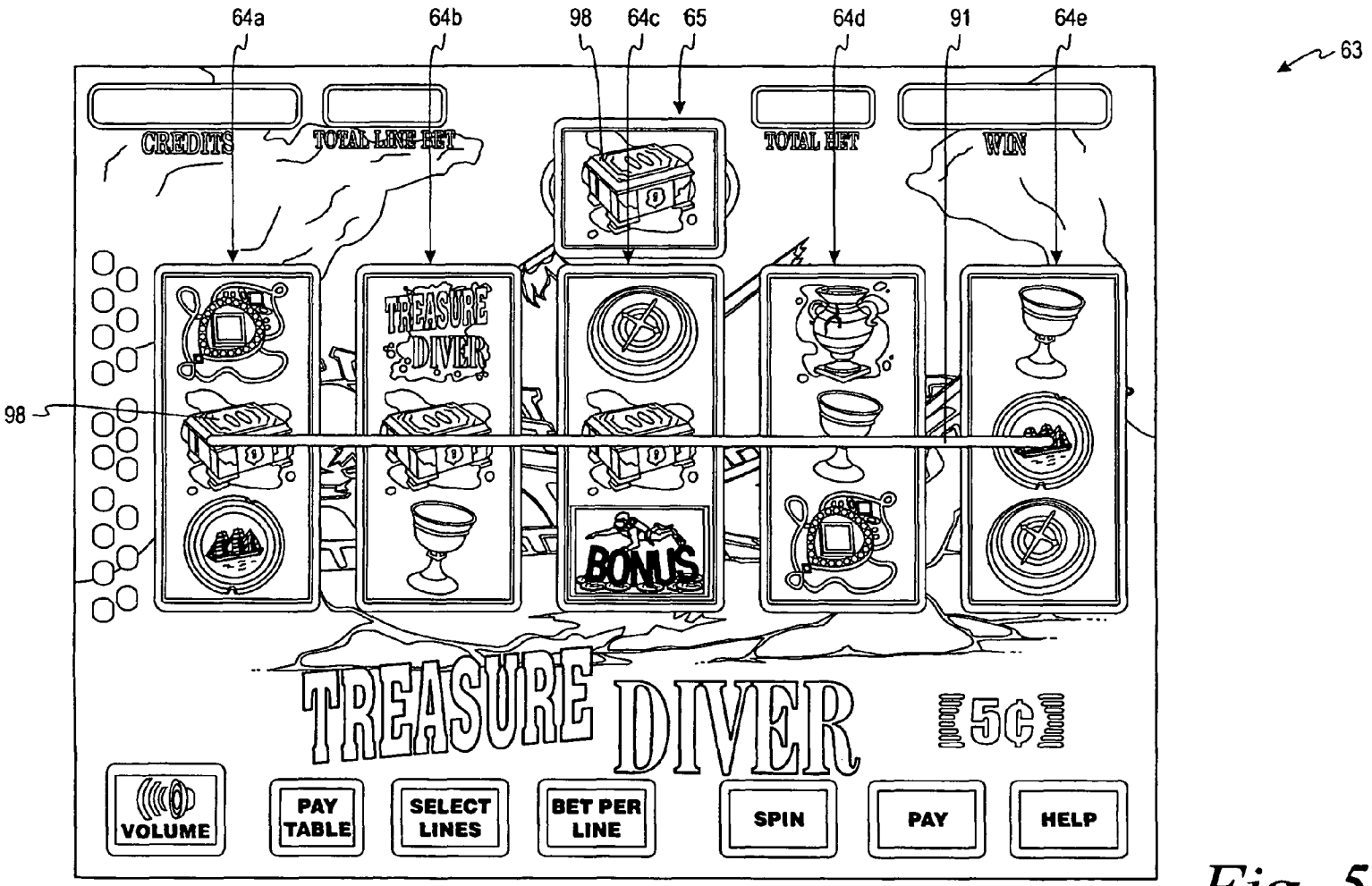
FIG. 5 is a screen view of the reels of the game of FIG. 4 after a play of the game.

In FIG. 4, the five depicted reels 64*a-e* have a plurality of symbols displayed thereon that are in association with a number of paylines (e.g., payline 91 in FIG. 5). Although the paylines themselves are not shown in FIG. 4, each payline may, for example, pass through a single symbol on each reel 64*a-e* as generally shown in FIG. 1 and as illustrated with payline 91 in FIG. 5. The leftmost ends of the various paylines are denoted by end markers 90, which may be color-coded to help distinguish the paylines from each other. The plurality of symbols displayed on the reels 64*a-e* is used to indicate a plurality of possible outcomes along each of the activated paylines. The depicted symbols generally correspond to a "TREASURE DIVER" theme and include: "NECKLACE" symbols 92; "RING" symbols 94; "CUP" symbols 96; "TREASURE BOX" symbols 98; "SHIELD" symbols 100; "BONUS" symbols 102; "TREASURE DIVER" symbols 104; "VASE" symbols 106; and "PLATE" symbols 108. Other TREASURE DIVER-themed symbols may also be depicted. In other embodiments of the present invention, the gaming machine 10 may portray other themes with corresponding like-themed symbols. Further, standard gaming symbols such as "1-BAR" symbols, "2-BAR" symbols, "3-BAR" symbols, "CHERRY" symbols, "SEVEN" symbols, and "BELL" symbols may be depicted on the reels 64*a-e* in other embodiments. The reels 64*a-e* displaying these symbols may be either traditional mechanical reels, such as the mechanical reels 54 described above, or video reels such as the video reels 54' described above.

A winning combination occurs when the symbols appearing along an active payline on the reels 64*a-e* correspond to one of the winning symbol combinations listed in a pay table stored in the system memory 36 of the gaming machine 10 (or on the external systems 50). The pay table may also be displayed on the secondary display area 16, the primary display area 14, or both and be either displayed constantly, intermittently, or upon request by a player (e.g., by selecting the pay-table button 80). Winning combinations listed in the pay table can include three like-symbols appearing on a payline yielding a first payout, four like-symbols appearing on a payline yielding a second, larger payout, five like-symbols appearing on a payline yielding a third, even larger payout, and six like-symbols appearing on an extended payline yielding a fourth, even larger payout.

A player may play multiple paylines by selecting the select-lines button 82 until the desired number of paylines is displayed. A gaming machine 10 with a single payline or multiple paylines will work with the present invention. Additionally, a gaming machine 10 with any plurality of reels may also be used in accordance with the present invention.

The supplemental single-symbol reel 65 ("reel 65") includes a plurality of symbols similar to or the same as those described above in relation to reels 64*a-e*. In one embodiment, the reel 65 is displayed by superimposing a video image of the reel 65 over the reels 64*a-e*, which can be either mechanical reels (e.g., mechanical reels 54) or video reels (e.g., video reels 54'), as mentioned above. In other embodiments, the reel 65 may be a video reel. While the reel 65 is displayed above the reels 64*a-e* on the basic game screen 63, the reel 65 may be displayed in other locations on the basic game screen 63, the primary display area 14 or the secondary display area 16.

In some embodiments, the reel 65 is spun each time the reels 64*a-e* are spun. In other embodiments, the reel 65 is spun with the reels 64*a-e* only if a secondary wager is placed in addition to a primary wager placed to spin the reels 64*a-e*. The price of the secondary wager to spin the reel 65 may be one-half the primary wager. Other amounts of wagers to spin the reel 65 are also contemplated. Generally, the reel 65 gives the player a chance to improve their win, as will be described below.

Figure 6:
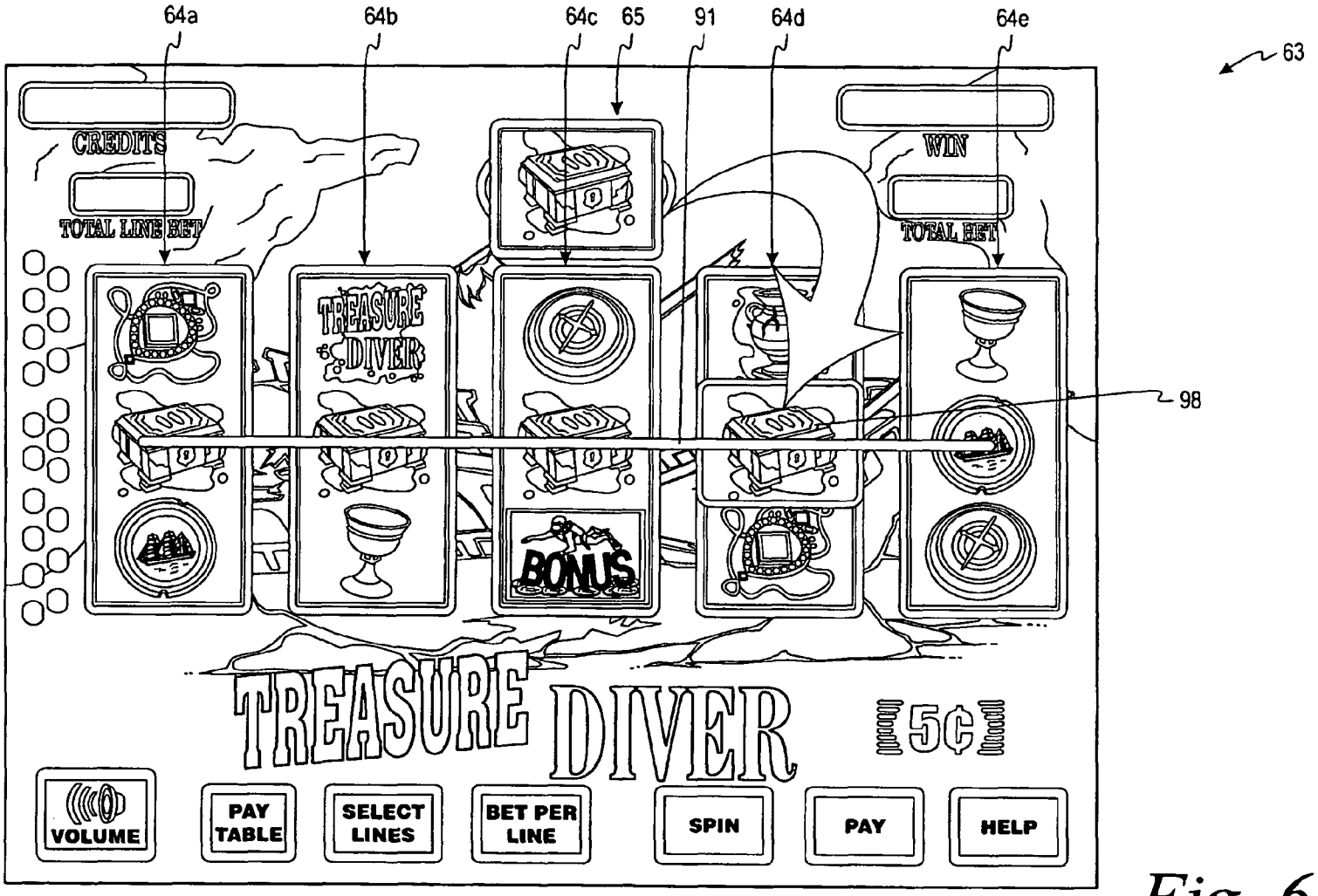
FIG. 6 is another screen view of the reels of the game of FIG. 4 after the play of the game.

Referring now to FIG. 5, the reels 64*a-e* and the reel 65 are displayed after a play of the basic game. A winning combination is formed along the reels 64*a-e* because three like symbols, the TREASURE BOX symbols 98, are aligned along the active payline 91. In accordance with one embodiment of the present invention, if a winning combination is formed on the reels 64*a-e* and the symbol displayed on the reel 65 matches the winning combination, as in the outcome illustrated in FIG. 5, the winning combination is extended by one symbol. This is shown by superimposing a video image of the symbol displayed on the reel 65 (i.e., the TREASURE BOX symbol 98) onto a position along the winning payline 91, as illustrated in FIG. 6. Thus, in the illustrated embodiment, the winning symbol combination formed by three-like symbols was extended from a three-symbol winning combination to a four-symbol winning combination. If the symbol displayed on the reel 65 does not match the symbols forming the winning symbol combination on the reels 64*a-e*, an increased award is not achieved and the award associated with the winning symbol combination on the reels 64*a-e* (i.e., three-like symbols) is awarded.

Figure 7:
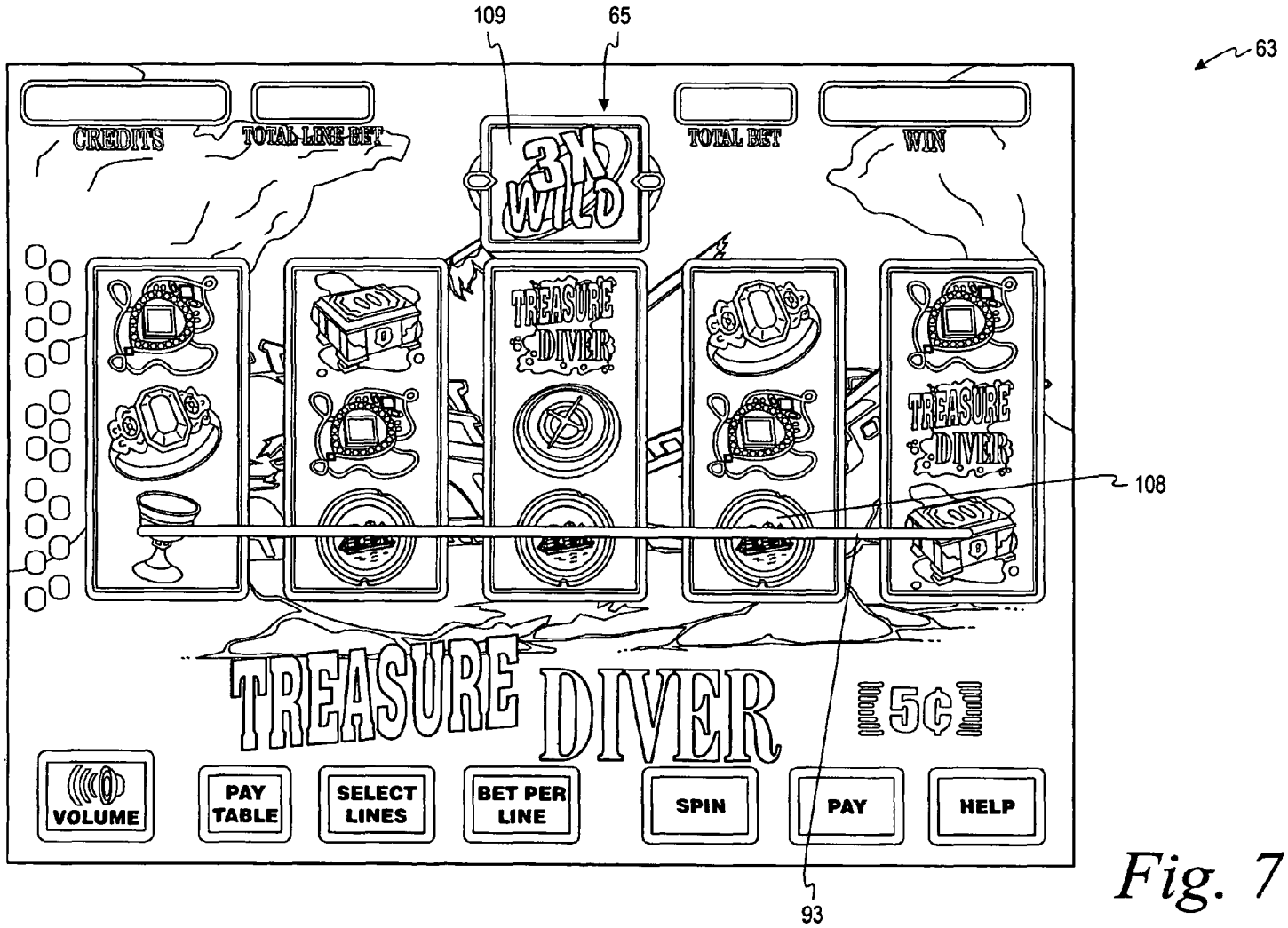
FIG. 7 is a screen view of the reels of the game of FIG. 4 after another play of the game.

In some embodiments, additional advantageous symbols may be included on the reel 65. For example, referring now to FIG. 7, a "3×" multiplier symbol 109 is displayed on the reel 65 after the reels 64*a-e* and the reel 65 have stopped spinning. If a winning combination is formed along an active payline (e.g., payline 93), the "3×" multiplier symbol 109 operates to multiply the winning symbol combination by three, yielding an award three times the amount of the award without the "3×" multiplier symbol 109. As illustrated in FIG. 7, a winning symbol combination is formed on the payline 93 by the three PLATE symbols 108. The "3×" multiplier symbol 109 thus may be superimposed along the payline 93 over the reels 64*a* or 64*e* and function to increase the award three times the original amount, i.e., three times the amount that would result from a three-PLATE symbol 108 winning combination.

Other multiplier symbols may also be used, such as, "2×" resulting in an increased award twice the amount of the original winning symbol combination, "4×" resulting in an increased award four times the amount of the original winning symbol combination, or other integer or non-integer numbers. Other advantageous symbols adapted to combine with a winning symbol combination resulting in an increased award are also contemplated.

Figure 8:
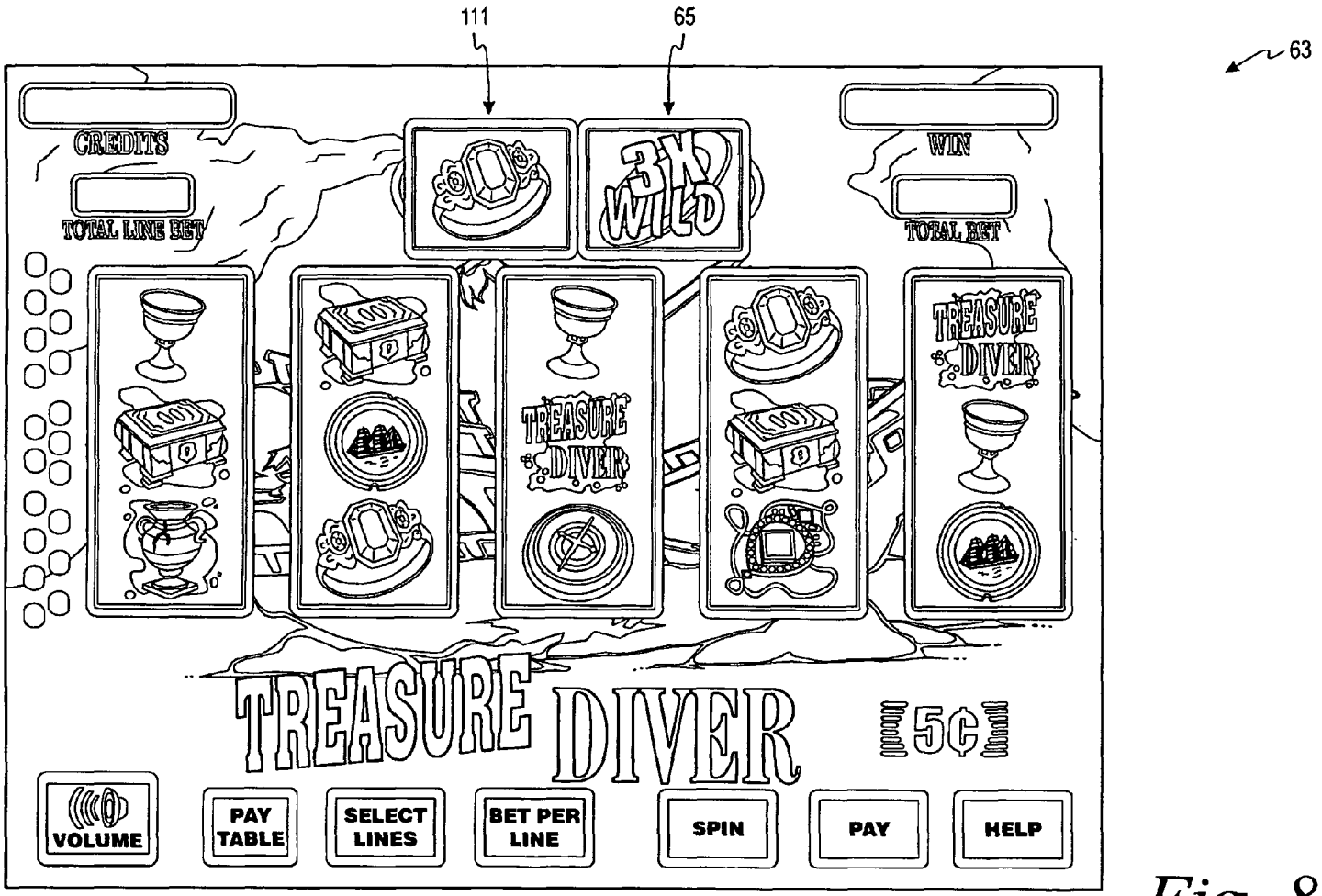
FIG. 8 is a screen view of an alternate embodiment of the game incorporating the present invention capable of being displayed on the gaming machine of FIG. 1.

In some embodiments, a second supplemental single-symbol reel may be added. Referring now to FIG. 8, an additional single-symbol reel 111 ("reel 111") is illustrated alongside the first supplemental single-symbol reel 65. Like the reel 65, the reel 111 may be displayed as a superimposed image over the reels 64*a-e* or as a purely video reel. Additionally, the location of the reel 111 is not limited to that illustrated in FIG. 8 and may be displayed anywhere on the main game screen 63, primary display area 14, or secondary display area 16. The second single-symbol reel 111, in some embodiments, may only be added during a free spin event or a bonus game.

The transmissive display 56 may assist in displaying the single-symbol reel 65, as well as single-symbol reel 111 in some embodiments, on the primary display area 14 with certain types of enhanced graphics upon the occurrence of certain conditions. For example, if the single-symbol reel 65 matches a winning symbol combination, the transmissive display 56 may display the reel 65 as a flashing image, a bursting image, or some other type of interesting graphic to indicate to the player an enhanced winning symbol combination has been earned. The transmissive display 56 may also enhance the reels 64*a-e* by highlighting winning symbol combinations via different colors or otherwise.

Each of these embodiments and obvious variations thereof is contemplated as falling within the spirit and scope of the claimed invention, which is set forth in the following claims.

What is claimed is:

1. A method of conducting a wagering game providing an opportunity to earn an increased award, the method comprising:

displaying a randomly selected outcome from a plurality of possible outcomes, the plurality of possible outcomes each including a plurality of symbols arranged in an array;

initially displaying an additional symbol separate from the array;

if the displayed randomly selected outcome includes a winning symbol combination resulting in a first award, determining whether the displayed additional symbol can be combined with the winning symbol combination to yield a second award, the second award being larger than the first award;

providing the first award if the additional symbol cannot be combined with the winning symbol combination to yield the second award; and providing the larger second award if the additional symbol can be combined with the winning symbol combination to yield the second award, wherein the additional symbol visually modifies one of the plurality of symbols to illustrate the combining of the additional symbol with the winning symbol combination.

2. The method of claim 1, wherein the plurality of symbols included in the randomly selected outcome is included on a plurality of mechanical multi-symbol reels displayed on a primary display area of the wagering game.

3. The method of claim 2, wherein the additional symbol is included on a single-symbol reel superimposed on the primary display area via a transmissive display.

4. The method of claim 1, wherein the additional symbol is a multiplier symbol multiplying the first award by a number to yield the second award.

5. The method of claim 1, wherein the winning symbol combination is at least three like-symbols appearing along an active payline.

6. The method of claim 5, wherein the additional symbol matches the three like-symbols of the winning symbol combination.

7. The method of claim 1, further comprising displaying a second additional symbol separate from the array and the additional symbol.

8. The method of claim 7, further comprising determining whether the displayed second additional symbol can be combined with the winning symbol combination to yield a third award, the third award being larger than the first award if the displayed plurality of symbols includes a winning symbol combination resulting in a first award.

9. The method of claim 8, further comprising initiating a free-spin event game or a bonus game from the wagering game, where the displaying of the second additional symbol only occurs in the initiated free-spin-event game or the bonus game.

10. A method of conducting a wagering game allowing an opportunity to form an enhanced winning symbol combination, the method comprising:

receiving a primary wager from the player for playing the wagering game;

initiating the wagering game;

displaying, via a plurality of reels having symbols thereon, a randomly selected outcome for the wagering game;

displaying a supplemental symbol in addition to the randomly selected outcome, the supplemental symbol being initially displayed separately from the plurality of reels; and in response to the randomly selected outcome forming a winning symbol combination and the supplemental symbol matching the winning symbol combination, combining the supplemental symbol with the winning symbol combination to form an enhanced winning symbol combination, wherein the supplemental symbol is configured to visually modify one of the plurality of symbols aligned with the winning symbol combination to illustrate the enhanced winning symbol combination in response to the enhanced winning symbol combination being formed.

11. The method of claim 10, further comprising:

achieving an award corresponding to the winning symbol combination if the supplemental symbol does not match the winning symbol combination; and achieving an award corresponding to the enhanced winning symbol combination if the supplemental symbol matches the winning symbol combination.

12. The method of claim 10, wherein the plurality of symbols displaying the randomly selected outcome are included on a plurality of multi-symbol reels displayed on a primary display area of the wagering game.

13. The method of claim 12, wherein the multi-symbol reels are mechanical reels.

14. The method of claim 13, wherein the supplemental symbol is included on a single-symbol reel superimposed on the primary display area via a transmissive display.

15. The method of claim 14, wherein the supplemental symbol visually modifies one of the plurality of symbols by superimposing the supplemental symbol over one of the plurality of symbols aligned with the winning symbol combination.

16. The method claim 10, further comprising receiving a secondary wager from the player to allow the display of the supplemental symbol.

17. A gaming system for playing a wagering game comprising:

a wager input device for receiving a primary wager to play a game of the wagering game; and a display for displaying a randomly selected outcome of the game and a supplemental symbol, the randomly selected outcome being indicated by a plurality of symbols arranged in an array, the supplemental symbol initially being unassociated with the array, wherein a first award is provided in response to the randomly selected outcome forming a winning symbol combination and a second award is provided if the supplemental symbol matches the winning symbol combination, the second award being greater than the first award, the supplemental symbol visually modifying one of the plurality of symbols to illustrate the combining of the supplemental symbol with the winning symbol combination.

18. The gaming system of claim 17, further comprising a transmissive display for displaying the modification of one of the plurality of symbols with the supplemental symbol, wherein the plurality of symbols are located on a plurality of mechanical multi-symbol reels.

19. The gaming system of claim 18, wherein the supplemental symbol is located on a single-symbol reel.

20. The method of claim 10, wherein the supplemental symbol visually modifies one of the plurality of symbols by animating movement of the supplemental symbol as initially displayed through the forming of the enhanced winning symbol combination.

* * * * *